United States Patent [19]

Kirk, Jr.

[11] Patent Number: 4,505,390

[45] Date of Patent: Mar. 19, 1985

[54] BOTTLE-NESTING CUP WITH THREE-POSITION HANDLE

[76] Inventor: Ronald K. Kirk, Jr., P.O. Box 535, Franklin, W. Va. 26807

[21] Appl. No.: 554,388

[22] Filed: Nov. 22, 1983

[51] Int. Cl.[3] ..... B65D 25/28

[52] U.S. Cl. ..... 206/547; 16/110 A; 16/114 R; 16/126; 16/DIG. 24; 215/100 A; 220/95

[58] Field of Search ..... 16/110 A, 110.5, 112, 16/114 R, 114 A, 120, 123, 124, 126, DIG. 24, DIG. 25, DIG. 40; 206/541, 545, 547, 549; 215/100 A; 224/148, 168, 169, 170, 171; 220/94 R, 95

[56] References Cited

U.S. PATENT DOCUMENTS

| | | | |
|---|---|---|---|
| 823,415 | 6/1906 | Krampitz | 16/114 A |
| 1,022,978 | 4/1912 | Stevenson | 16/114 A |
| 1,355,332 | 10/1920 | Hanson | 16/114 A |
| 1,373,156 | 3/1921 | Tebbetts | 206/547 |
| 1,809,596 | 6/1931 | Nason | 206/546 |
| 2,384,718 | 9/1945 | Witherspoon . | |
| 2,444,447 | 7/1948 | Josselyn | 16/110 A |
| 2,814,380 | 11/1957 | Thaxton, Jr. . | |
| 3,077,286 | 2/1963 | Cornelius . | |
| 3,420,401 | 1/1969 | Maslow | 16/114 A |

FOREIGN PATENT DOCUMENTS

| | | | |
|---|---|---|---|
| 895079 | 1/1945 | France | 220/95 |

*Primary Examiner*—George E. Lowrance
*Assistant Examiner*—Jimmy G. Foster
*Attorney, Agent, or Firm*—Cushman, Darby & Cushman

[57] ABSTRACT

A cup is disclosed which is nestable on the end of a hiker's plastic bottle. The cup has a handle which is movable between a stored position in which it nests around the outside of the cup body and a use position in which the handle extends out radially from the cup sidewall. The handle has a third position, reversed from the second, in which the handle loops up over the mouth of the cup from one side on the cup lip to a diametrically opposite site to provide a bail for suspended support of the cup, e.g. for hanging the cup over a fire. A pouch may be provided for permitting the user to wear the compact stowed-handle/bottle-nested cup unit. The cup handle includes a doubled wire member with tangs that removably mount in a bracket provided on the cup sidewall. A slider is provided on the handle, this slider being movable between a position where the handle is relatively fixed to the cup and a position where the handle can be shifted or changed from one to another of its three positions.

7 Claims, 8 Drawing Figures

BOTTLE-NESTING CUP WITH THREE-POSITION HANDLE

BACKGROUND OF THE INVENTION

Nalge Company, a division of Sybron Corp. of Rochester, N.Y. has been well-known in the laboratory equipment supply field for many years, particularly for its line of plastic equipment including bottles made of polyethylene, polypropylene and the like, much of which is sold under the trademark "Nalgene". Because they were originally designed to securely hold possibly hazardous chemicals, Nalgene (brand) polyolefin, screw-cap bottles are especially rugged and leakproof. Somewhere at some time, a chemist or chemistry student who was also a rock climber, a mountain climber, a camper, a backpacker, a bicycle tourer, a skier, a hunter or fisher, or like variety of hiker "adopted" a Nalgene bottle as his or her water bottle. Popularity of that bottle and others like it has rapidly increased to the point where such bottles are now standard items of equippage for hikers of all types. This is so even to the point that many people commonly but incorrectly use "Nalgene" or "nalgene" to denote a kind of usually right circular cylindrically bodied, usually translucent white, rugged polyolefinic plastic, capped bottle for carrying a hiker's water supply or other liquid supply regardless of the manufacturing source of the bottle. For convenience in description and to avoid misuse of the brand name, such a bottle will be termed a "hiker's plastic bottle".

Another item often packed by hikers is a cup, which may serve not merely to drink a liquid poured from the hiker's plastic bottle, but also as a vessel in which to hydrate or rehydrate and to mix beverage concentrates, freeze-dried meals, and the like, and as a server from which to drink and eat. One popular design of such a cap has a stainless steel body of frusto-conical, upwardly flaring form with a wire handle of hooked-loop form. This cup may also be used on a stove as a vessel in which to heat the hiker's food or drink however it is difficult to suspend such a cup over a fire where there is no convenient grating or other support means on which to support the cup over the heat. Further, the flared sidewall of the hitherto popular cup generally results in an inefficient use of some of the precious space in a hiker's pack.

SUMMARY OF THE INVENTION

A cup is disclosed which is nestable on the end of a hiker's plastic bottle. The cup has a handle which is movable between a stored position in which it nests around the outside of the cup body and a use position in which the handle extends out radially from the cup sidewall. The handle has a third position, reversed from the second, in which the handle loops up over the mouth of the cup from one side on the cup lip to a diametrically opposite site to provide a bail for suspended support of the cup, e.g. for hanging the cup over a fire. A pouch may be provided for permitting the user to wear the compact stowed-handle/bottle-nested cup unit. The cup handle includes a doubled wire member with tangs that removably mount in a bracket provided on the cup sidewall. A slider is provided on the handle, this slider being movable between a position where the handle is relatively fixed to the cup and a position where the handle can be shifted or changed from one to another of its three positions.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
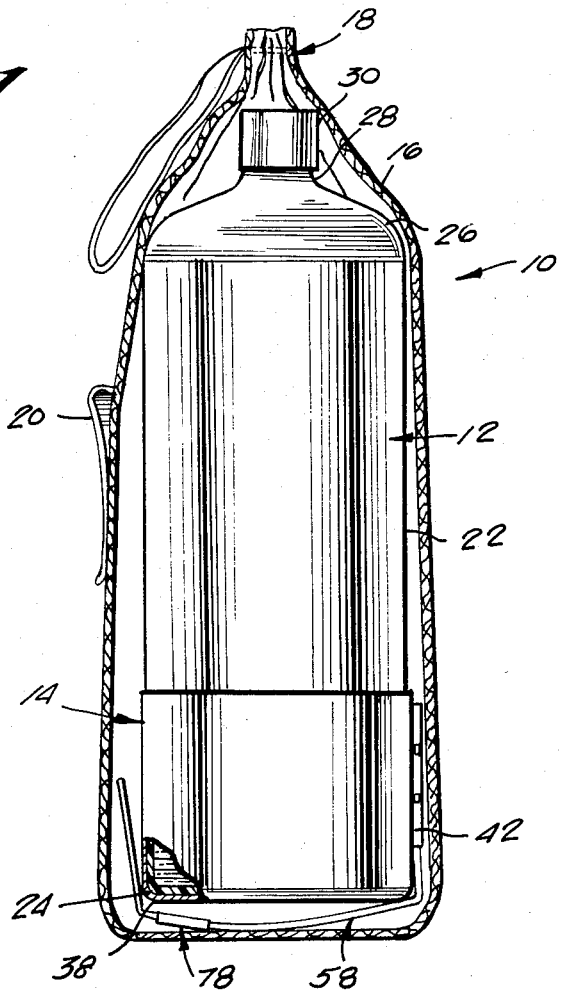
FIG. 1 is a longitudinal sectional view of a day hiker's bottle pack incorporating a hiker's plastic bottle nested with a cup embodying principles of the present invention.
Figure 2:
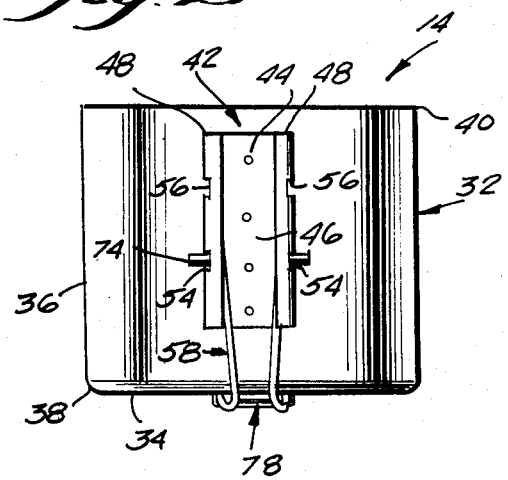
FIG. 2 is a right side elevational view of the cup of FIG. 1.
Figure 4:
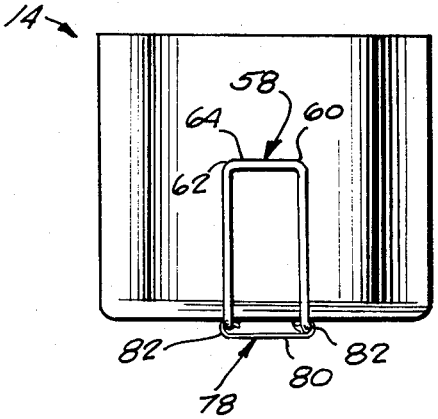
FIG. 4 is a left side elevational view thereof.
Figure 3:
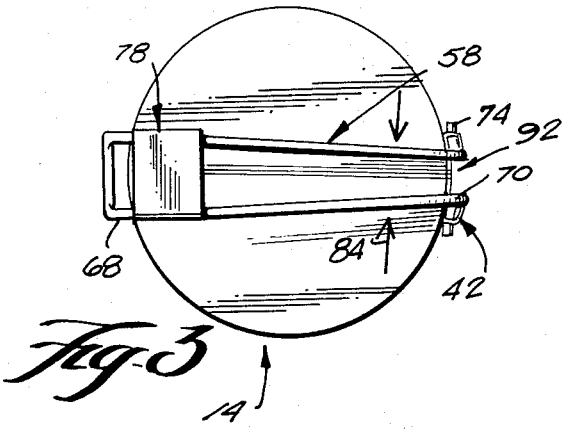
FIG. 3 is a bottom plan view thereof.

A day hiker's bottle pack is shown illustrated at 10 in FIG. 1 as including a hiker's plastic bottle 12 having a cup 14 fully removably nested on its bottom end, this assembly being removably stuffed in a soft bag, pouch or sack 16, e.g. having a draw string closure 18 and a loop or clip means 20 via which the pack 10 may be conveniently carried on the hiker's belt, or mounted to the frame of a bicycle or the like. Neither the bag 16 nor the bottle per se constitutes the present invention. Variations in structure and accoutrements of these items are possible; what is shown is illustrative and representative.

By preference, the bottle 12 has a body 22 that is of circular transverse cross-section, with a rounded corner 24 at the bottom and with a shoulder 26 at the top leading to a reduced-diameter neck 28 having a closure 30, e.g. a removable screw cap.

The cup 14 preferably is made of stainless steel, although for some uses it could be made of other materials.

The cup 14 is shown including a body 32 shaped to conform to the lower end of the bottle body 22. Accordingly, in the instance depicted, the cup body 32 comprises a generally flat disk-shaped bottom wall 34 integrally joined along its perimeter with an upstanding perimetrical sidewall 36 of right circular cylindrical form. The bottom wall 34 and sidewall 36 meet at a filleted, i.e. rounded corner 38 the shape of which is consistent with the body 32 having been formed by cupping, deep drawing, ironing, trimming and wire brushing an initially disk-shaped plate of stainless steel, all by conventional techniques. Accordingly, the cup body 32 is of generally uniform wall thickness throughout and its sidewall 36 upwardly terminates in an edge 40, which may be simply polished to deburr and round it as shown, or it may be conventionally provided with an outwardly curled lip.

To give some appreciation for typical scale, the bottle 12 is, for instance, a one quart or one liter bottle, and the cup measures about 3.5 inches (8.8 cm) across and about 3.0 inches (7.6 cm) high. However, the principles of the invention are not dependent upon absolute size of the cup body.

The cup body 32 is shown further including a handle mounting bracket 42 secured to the cup body sidewall 36, for instance by electronic spot welds at 44.

The bracket 42 is shown being constituted by a unitary, vertically elongated member of generally rectangular perimetrical shape having a relatively broad medial flange 46 and two laterally opposite end flanges 48 which curl out and double back over the medial flange 46 so as to provide two opposed grooves, gaps, troughs or the like 50 which open in the medial direction, i.e. which open towards one another across the outer face 52 of the medial flange 46.

Each end flange 48 is shown having a first hole 54 formed laterally therethrough at a first, lower level and a second hole 56 formed laterally therethrough at a second, higher level. Each opening 54, 56 is shown being of a diameter that is substantially equal to the thickness of the respective gap 50.

The cup 14 is shown further including a handle 58. By preference, the handle 58 is constituted by a length of heavy gauge stainless steel wire or bar bent to U-shaped form along two mutually orthogonal axes. For instance, the length of wire is first bent at about a right angle at 60 and 62 to form the relatively short cross member or base 64 and relatively long arms 66 of a planar U-shaped intermediate product. The top and bottom approximately one quarter of the U-shaped intermediate are bent at about a right angle at 68, 70. The free ends of the arms are bent laterally outwards at 72 to form respective tangs 74 which project generally axially away from one another on a common axis that is generally parallel to and generally coplanar with the base 64. The left and right two elements 76 of the central portion of the handle may be gently bent so as to arch them convexly away from the common plane of the base 64 and tangs 74, as shown.

The handle 14, as shown, is completed by a slider 78 shown comprising a clip like body of generally C-shaped form having a central flange 80 which bridges between the two elements 76 of the central portion of the handle and a two laterally opposite marginal flange portions 82 which curl about the respective elements 76. The flange portions 82 are only lightly crimped, tightly enough keep them curled about the respective elements 76, but loosely enough that the slider 78 can be slid from a position near the bends 68 to a position near the bends 70. Preferably the slider will stay put until it is intentionally slid.

It should be apparent that when the slider is near the bends 70, e.g. nearer the base 64, the tangs and free ends of the handle may be resiliently flexed towards one another, i.e. in the direction of the arrows 84, but when the slider is near the bends 68, i.e. nearer the tangs 74, the slider acts as a compression strut or brace to maintain a relatively spread condition of the handle elements and tangs and prevent flexure of these members in the medial direction.

The lengths of the tangs 74 preferably are such that when the elements 76 are resiliently squeezed together so that they abut one another at 86, the respective end 88 of the handle is slightly narrower than the width of the slot 90 defined by the opposed grooves 60. Accordingly, the respective handle end may then be slid into the slot 90 at one end, or at an intermediate position by cocking the handle, inserting the tangs in the opening 92 and straightening-up the handle. Either way, as the handle is brought to a place where its tangs are aligned with one or the other of the sets of openings 54 or 56 and no longer squeezed, the springiness of the handle material will cause the tangs to be thrust out through the respective openings 54 or 56.

With the handle tangs thus installed in the respective lower openings 54, so that the handle is concave towards the bottom of the cup body the handle may be rotated until it nests and embraces the lower portion of the cup body, i.e. is folded under the bottom of the cup as shown in FIGS. 1–4. As this position is reached, the leg portions 94 of the handle snap into the respective grooves 50, thereby lightly retaining the handle in its stored position The handle may be locked in this position, if desired, by sliding the slider 78 over towards the bends 68. Usually the light detention provided by the resilient popping of the legs 94 into the grooves 50 will be sufficient without a need for locking via slider movement.

Figure 5:
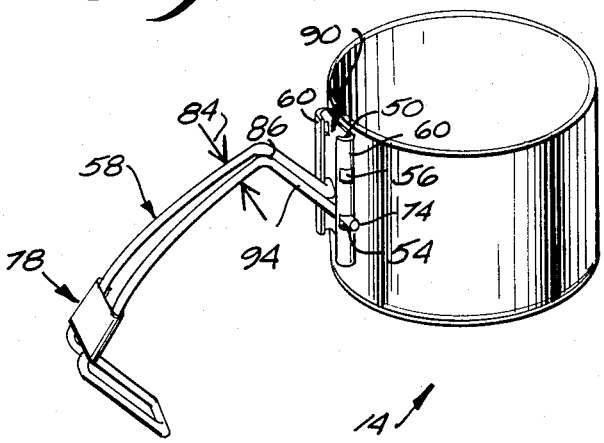
FIG. 5 is a perspective view of the cup with the handle rotated from the storage position almost to the use position.
Figure 6:
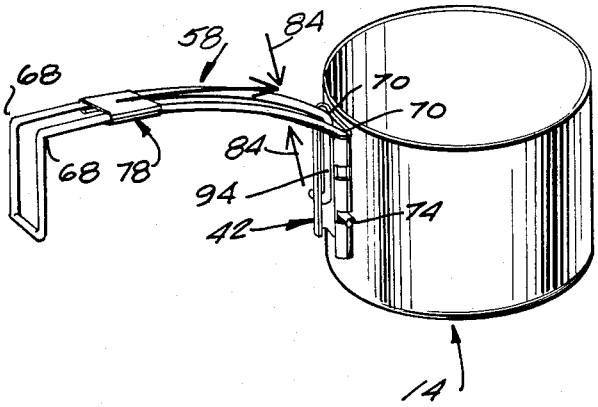
FIG. 6 is a similar perspective view showing the handle locked in its use position by means of the slider.
Figure 7:
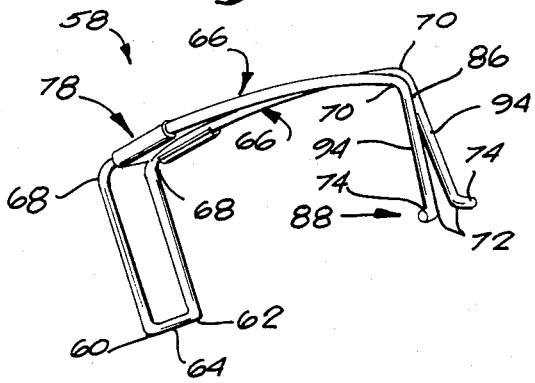
FIG. 7 is a perspective view of the handle as removed from the cup for reversal.

When it is desired to move the handle from its storage position to its use position, the user simply grasps the handle, e.g. near the cross member 64 and rotates it through 180 degrees about the axis of the tangs, as shown in FIGS. 5 and 6 (after having slid the slider back towards the bends 70 if the slider had been placed in its locking position). As the use position of the handle is reached, the handle legs 94 again pop into the respective grooves 50, thereby, lightly retaining the handle in its use position. However, to ensure that the weight of food or drink placed in the cup does not cause the handle legs 94 to pop out of the grooves 50 and the handle to become non-supportive, the user should slide the slider forwards toward the bends 68. That will lock the handle in its use position as described above. See FIG. 6.

Figure 8:
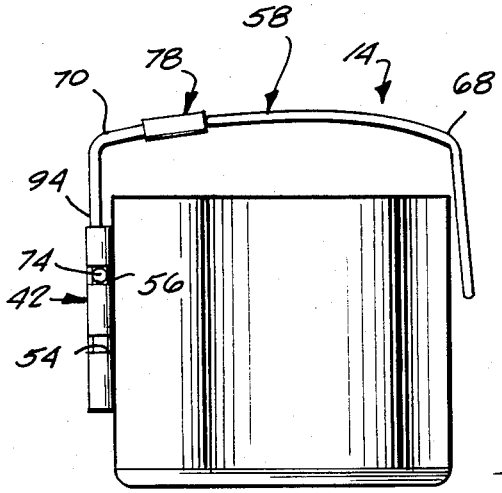
FIG. 8 is a side elevational view of the cup with its handle locked in the third position for use as a bail for suspending the cup over a fire.

In order to use the handle in its third position as a bail by which the cup may be hangingly supported, e.g. for warming cup contents over a fire, the slider 78 is slid out towards the bends 70, the legs 94 are squeezed together to free the tangs from the openings 54 and the handle is removed from the cup body, reversed, and reinstalled with the tangs in the openings 56. Once again, after the handle has been brought to the position shown in FIG. 8, so that the handle legs 94 pop into the grooves 50, the slider 50 is slid towards the bends 68 to lock the handle in its third position.

Many modifications and adaptations are possible. For instance, some users will want the sack 16 to be made of thermal insulating material in order to keep their food or drink cold or hot. Others will not want a sack at all, as they will carry their bottle/cup assembly in their knapsack or backpack or the like. Yet others will value the cup for its own sake and seldom or never nest it to a bottle bottom. Other cross-sectional shapes for the bottle body and thus of the cup body are possible, for instance round-cornered, square sectioned, or oval-shaped. Some users may want more than two sets of holes 54, 56, so that the handle may be mounted "frontwards" or "backwards" at more than two levels. And some may prefer to manufacture the handle with somewhat longer legs 94 so that one set of two openings 54 positioned about half-way up the height of the cup body will suffice for both "frontwards" and "backwards" mounting of the cup handle.

According to the presently preferred embodiment of the invention, the cup 14 is designed to fully nest with the bottom of the bottle 12; it could be nested with the top of the bottle, much as the cup of some vacuum (Thermos) bottles does double duty as a cap or overcap. However, that could waste precious space in a pack. That is why bottom-nesting is preferred, as in such an instance, the cup will occupy almost no space in the pack.

It should now be apparent that the bottle-nesting cup with three-position handle as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A cup with an adjustably-positioned handle, comprising:

a cup body having a bottom wall with an upstanding peripheral sidewall joined thereto, which sidewall terminates in a rim;

bracket means exteriorly disposed on said sidewall and mounted thereto, said bracket means including means providing at least one pair laterally spaced, laterally opening pintle sockets, the sockets of each pair being disposed at a respective common level; for at least one said pair of sockets, two pair of laterally spaced groove means which open laterally one pair above and the other below said one pair of sockets;

a handle comprising a generally U-shaped wire member of resilient material, said member having a base portion including a cross member and two generally parallel portions each joined to a respective end of the base portion and having a free end; a laterally directed pintle formed at each said free end, these two pintles extending in opposite directions generally on a common axis; said two generally parallel portions of said wire member being bent intermediate the longitudinal extent thereof at about right angles about an axis generally parallel to said common axis of said pintles so as to provide a bend in said handle and so as to define legs of said handle between said bend and said pintles;

said pintles being removably received in said one pair of pintle sockets, with said legs being constructed and arranged to resiliently snap into one pair of said groove means when said handle is rotated about said pintle means to a use position wherein said handle, beyond said bend from said legs projects generally radially outwards from said sidewall of said cup body and to resiliently snap into said other pair of said groove means when said handle is rotated about said pintle means to a storage position wherein said handle, beyond said bend from said legs projects generally diametrically across the underside of said bottom wall of said cup body;

a slider slidably mounted on said generally parallel portions of said handle beyond said bend, said slider including a substantially incompressible strut extending laterally between said two generally parallel portions and two opposite barrel portions curled about respective ones of said two generally parallel portions, said slider being constructed and arranged to be manually slid between a first portion nearer said base of said handle, in which case said legs may be resiliently moved close enough together to clear the respective said groove means, so that the handle may be rotated out of whichever of said storage position and use position that it is in, and a second position nearer said bend, in which case said legs are braced apart and cannot clear the respective said groove means, so that the handle may be locked in whichever of said storage position and said use position that it is in;

said two generally parallel portions of said wire member being provided with a second bend about an axis generally parallel to the first described bend, this second bend also being at about a right angle and being spaced from the first-described bend by a distance that is at least equal to the width of the bottom wall of the cup, so that when the handle is in said storage position thereof, said handle beyond said second bend extends up the outside of the cup sidewall at a site diametrically opposed to that of said bracket means;

said slider being disposed between the first-described and second bends;

said pintles being constructed and arranged to be so short that when said handle legs are resiliently squeezed close together when said slider is positioned close to the second bend, the handle may be completely separated from the cup body, reversed 180 degrees about an axis that is generally radially oriented relative to said cup body sidewall, and said pintles reinstalled in a set of said pintle sockets in this new orientation, whereby said handle may be rotated about said pintles to a third position, the last-mentioned said set of said pintle sockets being so positioned, heightwise, on said bracket means on said cup body sidewall, relative to the lengths of said legs of said handle between said bend and said pintles that, in said third position of said handle, said bend of said handle is disposed at a sufficiently high level in relation to said rim of said cup sidewall that said handle between said bend and said base arches bail-fashion over the cup body;

said cup further including means on said cup body for holding said handle in said third position.

2. The cup of claim 1, wherein:

said holding means is constituted by said one pair of groove means and by said slider.

3. The cup of claim 2, wherein:

said at least one pair of pintle sockets is constituted by two pair of pintle sockets including a first pair disposed at a lower level for use when said handle is in said use and said storage positions and a second pair disposed at a higher level for use when said handle is in said third position.

4. The cup of claim 1, wherein:

said two generally parallel portions of said wire member are provided with a second bend about an axis generally parallel to the first described bend, this second bend also being at about a right angle and being spaced from the first-described bend by a distance that is at least equal to the width of the bottom wall of the cup, so that when the handle is in said storage position thereof, said handle beyond said second bend extends up the outside of the cup sidewall at a site diametrically opposed to that of said bracket means;

said slider being disposed between the first-described and second bends.

5. The cup of claim 1, wherein:

said bracket means is constituted by an integral member having a medial flange and two laterally opposite marginal flanges which curl outwardly and towards one another to provide all of said groove means;

said pintle sockets being constituted by means defining respective openings through said marginal flanges; and said pintles projecting laterally away from one another.

6. The cup of claim 5, wherein:

said cup is made of stainless steel and said integral member is spot welded to said cup body sidewall.

7. The cup of claim 1, further comprising:

a hiker's plastic bottle having a bottom wall, a generally cylindrical sidewall, a shoulder leading to a neck provided with an openable closure; said hiker's plastic bottle having a lower portion thereof including said bottom wall and a lower portion of said sidewall substantially fully but removably nested in said cup body.

* * * * *